United States Patent [19]

Kashio

[11] 4,374,622

[45] Feb. 22, 1983

[54] DIGITAL ALARM TIMEPIECE WITH SETTING POINTER

[75] Inventor: Toshio Kashio, Tokyo, Japan

[73] Assignee: Casio Computer Co., Ltd., Tokyo, Japan

[21] Appl. No.: 114,569

[22] Filed: Jan. 23, 1980

[30] Foreign Application Priority Data

Jan. 29, 1979 [JP] Japan ..... 54-8892
Jan. 29, 1979 [JP] Japan ..... 54-8893

[51] Int. Cl.[3] ..... G04B 23/02; G04C 9/00
[52] U.S. Cl. ..... 368/74; 368/187
[58] Field of Search ..... 368/73, 251, 74, 83, 368/84, 82, 252, 253, 187, 188, 189

[56] References Cited

U.S. PATENT DOCUMENTS

| | | | |
|---|---|---|---|
| 3,775,967 | 12/1973 | Spadini | 368/252 X |
| 3,852,952 | 12/1974 | Vittoz et al. | 368/188 |
| 4,040,248 | 8/1977 | Laesser | 368/252 |
| 4,121,415 | 10/1978 | Crutcher et al. | 368/240 |
| 4,196,583 | 4/1980 | Komaki | 368/251 |
| 4,246,602 | 1/1981 | Sekiya et al. | 368/71 |

*Primary Examiner*—Vit W. Miska
*Attorney, Agent, or Firm*—Frishauf, Holtz, Goodman & Woodward

[57] ABSTRACT

An electronic timepiece has an optical display device for displaying time in digits and an alarm time indicator for setting an alarm time in terms of the position of a pointer. The position of the pointer is electronically detected and is applied as alarm time data to a time counting circuit. When current time is coincident with the alarm time set by the pointer, the alarm is given.

3 Claims, 5 Drawing Figures

DIGITAL ALARM TIMEPIECE WITH SETTING POINTER

BACKGROUND OF THE INVENTION

The invention relates to an electronic timepiece for displaying time by using an optical display device.

An electronic timepiece with a liquid crystal display device or a light emission diode display device to digitally display time such as minute or hour, has been known as an electronic timepiece for displaying time by using an optical display device. This type of electronic timepiece can be set to an alarm time. To change the alarm time thus set to another alarm time, a switch is operated to select a unit of time and the units digit and/or the tens digit of the time unit and then another switch is operated to change the time set at the units digit and/or the tens digit thus selected. To operate two switches in order to change an alarm time is rather troublesome. Further, to prevent these switches from being operated by mistake, a safety switch is required. Consequently, the timepiece should be provided with many switches.

Various timepieces with an alarm function and an optical display device are now widely marketed. When an alarm time is set in such an alarm timepiece, it is displayed in place of the current time. While seeing the alarm time displayed, the user operates a switch to select a unit of time and the units digit and/or the tens digit of the time unit and then operates another switch to change the time set at the units digit and/or the tens digit thus selected. The alarm timepiece further has a switch for selecting a time-setting mode or an alarm time-setting mode. As described above, the conventional timepieces need many switches, and as many switching operations must be made. For this, the switching operation is complicated, thus causing erroneous switching operations.

Accordingly, an object of the invention is to provide an electronic timepiece which may decrease the number of switches, reliably correct time by a simple operation and which is easy to handle.

Another object of the invention is to provide an electronic timepiece which is very handy and easy to set an alarm time.

SUMMARY OF THE INVENTION

To achieve those objects of the invention, there is provided an electronic timepiece comprising time counting means for electronically counting current time data such as minute and hour, optical display means for displaying the current time data counted by the time counting means, indicating means for indicating a set time in terms of a stop position of a sliding member, detecting means for electronically detecting set time data corresponding to the set time indicated by the indicating means, and operating means for presetting the set time data detected by the detecting means in the time counting means.

With such a construction, the operation of the timepiece is very easy. The correct time or an alarm time may be reliably set for a short time and reliably. The timepiece need not be provided with such switches as used in the conventional timepiece to select a time unit and the units digit and/or the tens digit of the time unit and to change the time set at the units digit and/or the tens digit thus selected. This reduces the number of necessary switches.

DETAILED DESCRIPTION

Figure 1:
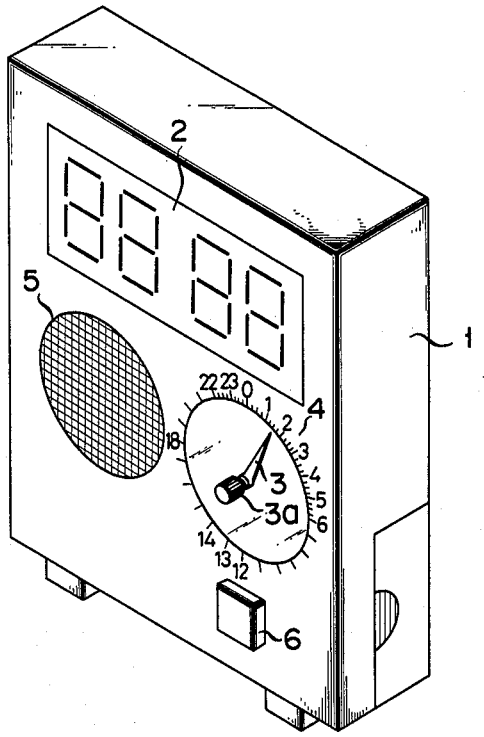
FIG. 1 shows a perspective view of an electronic timepiece incorporating the invention.

An embodiment of an electronic timepiece according to the invention will be described referring to the drawings. As seen in FIG. 1, on the front panel of a casing 1 are provided a digital display device 2 using optical display means, for example, liquid crystal display elements, a set time indicator 4 with a pointer 3 for setting an hour of day, at an alarm sounding section 5, and an hour setting switch 6. The pointer 3 of the set time indicator 4 is rotatable clockwise or counterclockwise by means of a knob 3*a* axially aligned with the pointer 3. As shown, a circle traced by the tip of the pointer 3 when it rotates is divided into 24 segments marked with numerals 0 to 23 and each segment is further divided into four subsegments. The segments 0 to 23 form a time scale representing 0 to 23 hour and the subsegments each represent fifteen minutes. As a matter of course, those segments and subsegments serve as graduations on the time scale. The set time indicator 4 contains a plurality of contacts to provide the position data of the pointer 3. The detail of a detecting means for detecting the position of the pointer 3 will be described subsequently.

Figure 2:
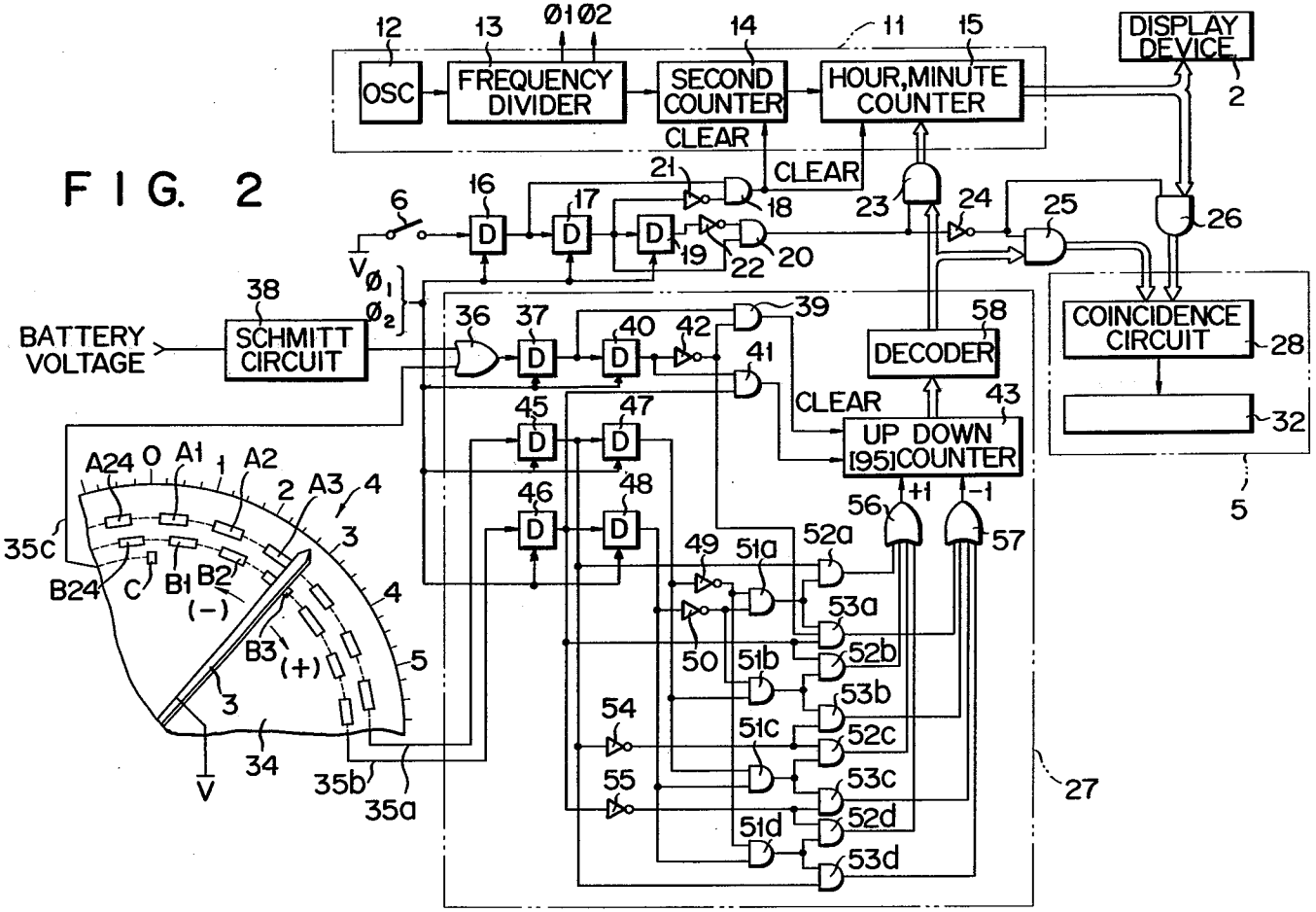
FIG. 2 shows a circuit diagram of the electronic timepiece shown in FIG. 1.

An overall circuit construction of the timepiece shown in FIG. 1 will be described referring to FIG. 2. In the figure, a time count circuit 11 is comprised of an oscillator 12 for generating a reference signal, a frequency divider 13 which frequency-divides the reference signal from the oscillator 12 to produce clock pulses $\phi 1$ and $\phi 2$ having the same periods but different phases and to produce a signal with the period of one second, a second counter 14 which counts the one second signal from the frequency dividing circuit 13 to produce a signal with the period of one minute, and a minute/hour counter 15 which counts the one minute signal from the second counter 14 to count times of minute and hour. The minute and hour data produced from the minute/hour counter 15 are transferred to a display device 2 where those are visualized. An output signal produced upon the operation of the time setting switch 6 is loaded into a delayed flip-flop circuit (DF/F circuit) 16 in synchronism with the clock pulse $\phi 1$ and the loaded one is produced from the DF/F circuit 16 in synchronism with the clock pulse $\phi 2$. The output of the DF/F circuit 16 is inputted to a DF/F circuit 17 and an AND circuit 18. The output of the DF/F circuit 16 is further applied to a DF/F circuit 19 and an AND circuit 20, and through an inverter 21 to the AND circuit 18. The output signal from the AND circuit 18 is applied as a clear signal to the second counter 14 and the minute/hour counter 15. Like the DF/F circuit 16, the DF/F circuits 17 and 19 receive input signals in synchronism with the clock pulse $\phi 1$ and produce output signals in synchronism with the clock pulse $\phi 2$. The output of the DF/F circuit 19 is applied through an inverter 22 to the AND circuit 20. The output signal from the AND circuit 20 is applied as a gate signal to an AND circuit 23 and further applied as a gate signal to AND circuits 25 and 26, through an inverter 24. The time data from a pointer position detecting circuit (referred to as a sensing circuit) 27 is applied to the AND gates 23 and 25. The output signal from the AND circuit 23 is applied as the current time setting data to the minute/hour counter 15. The output signal from the AND circuit 25 is applied as alarm data to a coincidence circuit 28. The output signal from the minute/hour counter 15 is applied to the AND circuit 26 of which the output signal is applied as the current time data to the coincidence circuit 28. The output signal from the coincidence circuit 28 is transferred to a sounding means 32, for example, a speaker, to generate a buzzing sound, a chime, a melody or the like.

Figure 3A:
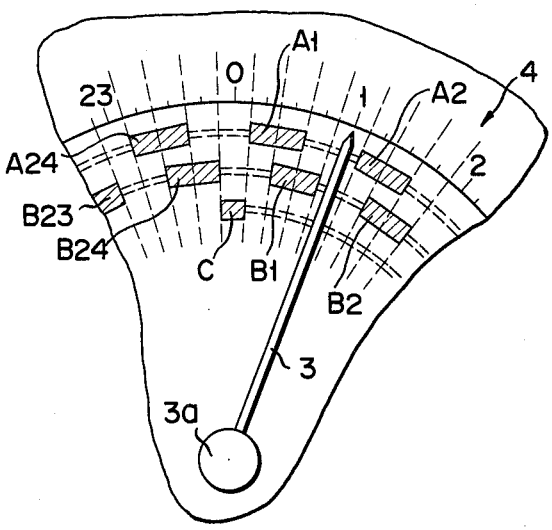
FIGS. 3(*a*) and 3(*b*) show the structure of a set time indicator for sensing a position of a pointer which is used in the electronic timepiece shown in FIG. 1.
Figure 3B:
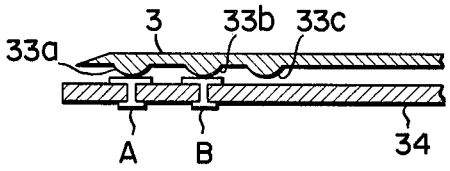

As described above, the set time indicator 4 visually indicates a set time depending on the position of the pointer 3 and applies the position signal representing the pointer position to the detecting circuit 27 for detecting the position of the pointer 3. More specifically, the pointer 3, which is rotated by means of the knob 3*a*, is supplied with a voltage V and comes in contact with fixed electrodes A1 to A24 and B1 to B24, and a reference electrode C, as shown in FIG. 2 and FIGS. 3(*a*) and 3(*b*). Those electrodes are formed on an insulating board 34. The fixed electrodes A1 to A24 and B1 to B24 are disposed at fixed intervals along the periphery of the time scale 0 to 24. The length of each fixed electrode ranges two graduations of the time scale, i.e. two subsegments, and the fixed intervals between the adjacent fixed electrodes are each two graduations, too. Further, the fixed electrodes A1 to A24 are disposed shifted clockwise from the marks 0 to 23 on the time scale by a half graduation. The fixed electrodes B1 to B24 are further clockwise shifted from the fixed electrodes A1 to A24 by one graduation. The reference electrode C is provided at the position corresponding to the "zero hours" mark on the time scale. As well illustrated in FIG. 3(*b*), projections 33*a* to 33*c* are formed on the underside of the apex portion of the pointer 3, facing the fixed electrodes A1 to A24 and B1 to B24, and the reference electrode C, respectively. Those projections 33*a* to 33*c* come in contact with the electrodes A to C with the rotation of the pointer 3. The fixed electrodes A1 to A24 and B1 to B24 are electrically connected properly on the insulating board 34 and led to exterior through lead wires 35*a* and 35*b*. The reference electrode C is led to the exterior through a lead wire 35*c*. When the pointer 3 contacts any one of the electrodes A1 to A24, B1 to B24 and C, a "1" signal flows through the lead wires 35*a* to 35*c*. The output signal provided through the lead wire 35*c* is transferred through an OR circuit 36 to a DF/F circuit 37 in the detecting circuit 27. A signal produced from a Schmitt circuit 38, which produces a "1" signal when receiving a voltage from a power source, for example, a battery, is further transferred through the OR circuit to the DF/F circuit 37 to initiate cleaning of the up/down counter 43 as described below. The output signal from the DF/F circuit 37 is applied to an AND circuit 39 and a DF/F circuit 40. Like the DF/F circuits 16 and 17 mentioned above, the DF/F circuits 37 and 40 operate in synchronism with the clock pulses $\phi$1 and $\phi$2. The output signal from the DF/F circuit 40 is inputted to an AND circuit 41 and through an inverter 42 to an AND circuit 39. The output signal of the AND circuit 39 is applied as a clear signal to an up/down counter 43. The output signal from the AND circuit 41 is applied as a preset signal to the up/down counter 43. The up/down counter 43 is so designed that, when it receives the preset signal, the maximum division value "95", for example, of the set time indicator 4 is preset in the counter 43 through the action of the internal circuit of the counter 43. To be more specific, in the embodiment under discussion, the interval corresponding to one hour on the time scale is quartered, so that the time scale of 24 hours has 96 divisions. These 96 divisions are assigned to "0" to "95" of the up/down counter 43. It is for this reason that "96" is preset in the up/down counter 43. The signals led through the lead wires 35*a* and 35*b* are applied to DF/F circuits 45 and 46 within the detecting circuit 27 of which the output signals are inputted to DF/F circuits 47 and 48, respectively. Those DF/F circuits 45 to 48 operate in synchronism with the clock pulses $\phi$1 and $\phi$2. The output signals from the DF/F circuits 47 and 48 respectively are applied through inverters 49 and 50 to an AND circuit 51*a*. The output signals from the DF/F circuit 47 and the inverter 50 is applied to an AND circuit 51*b*; the output signals from the DF/F circuits 47 and 48 to an AND circuit 51*c*; the outputs of the DF/F circuit 48 and the inverter 49 to an AND circuit 51*d*. The output signal of the AND circuit 51*a* is applied to AND circuit 52*a* and 53*a*; the output signal of the AND circuit 51*b* to AND circuits 52*b* and 53*b*; the output of the AND circuit 51*c* to AND circuits 52*c* and 53*c*; the output of the AND circuit 51*d* to AND circuits 52*d* and 53*d*. The output signal from the DF/F circuit 45 is applied to the AND circuit 52*a* and 53*d* and through an inverter 54 to the AND circuits 53*b* and 52*c*. The output signal from the DF/F circuit 46 is applied to the AND circuits 41, 53*a* and 52*b* and through an inverter 55 to the AND circuits 53*c* and 52*d*. Applied to the AND circuit 53*a* is the output signal from the inverter 42. The output signal from each AND circuit 52*a* to 52*d* is applied as a count up signal of +1 to the up/down counter 43, through an OR circuit 56. The output signal from each AND circuit 53*a* to 53*d* is applied as a count down signal of −1 to the up/down counter 43, through an OR circuit 57. In other words, when the pointer 3 of the set time indicator 4 is rotated clockwise, a "1" signal is produced from any one of the AND gates 52*a* to 52*d* while, when it is rotated counterclockwise, a "1" signal is produced from any one of the AND circuits 53*a* to 53*d*. The up/down counter 43 counts up or counts down in response to the count up signal coming through the OR circuit 56 and the count down signal coming through the OR circuit 57. The count is held at a value corresponding to the position of the pointer 3. The count value of the up/down counter 43 is decoded by a decoder 58 to be described later, and the decoded one is transferred as the output signal from the detecting circuit to the AND circuits 23 and 25.

Figure 4:
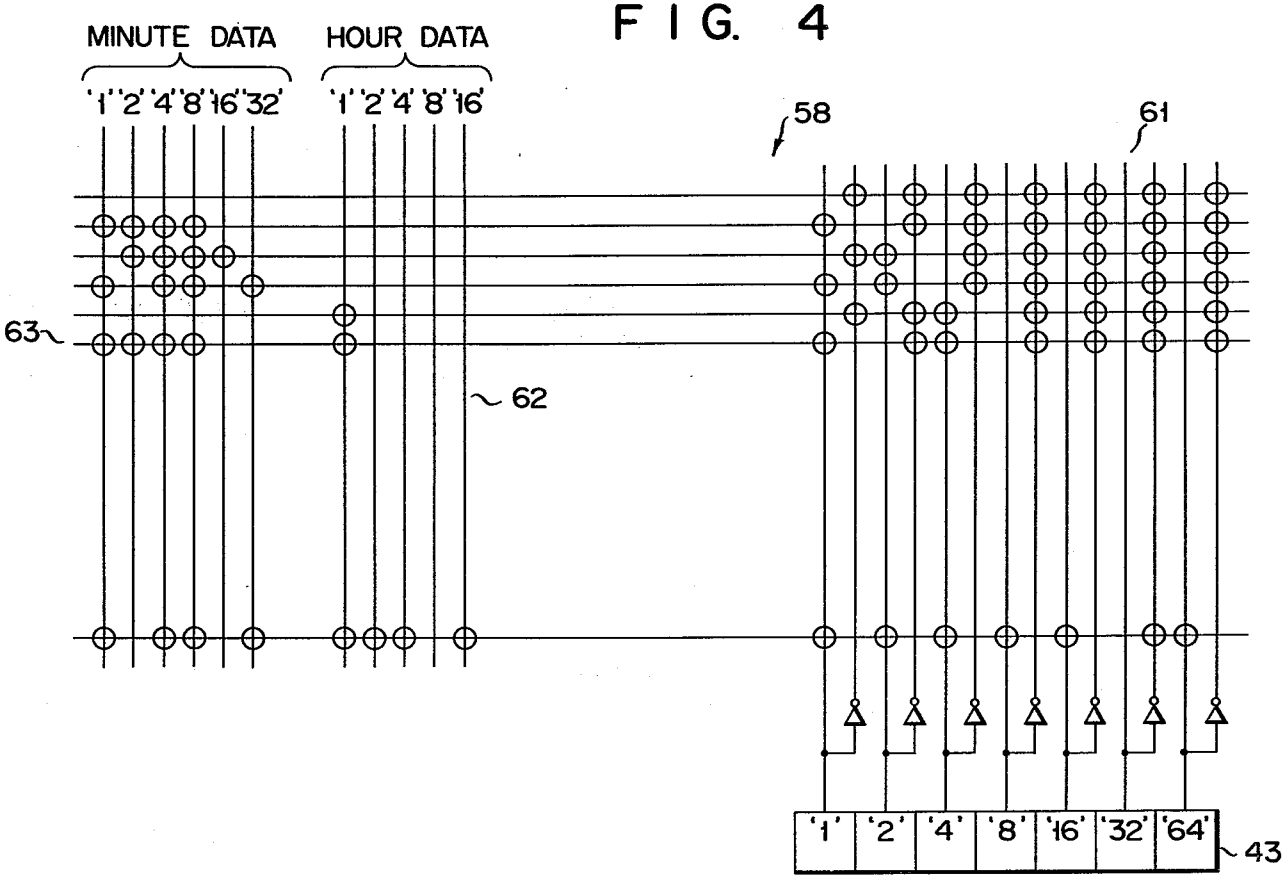
FIG. 4 shows a circuit diagram of a decoder used in the timepiece shown in FIG. 1.

Turning now to FIG. 4, there is shown the details of the decoder 58. The decoder 58 is comprised of a decoding circuit 61 for decoding a code signal of 7 bits corresponding to each of "0" to "95" produced from the up/down counter 43, and encoding circuits 62 and 63 for converting the output signal from the decoding circuit 61 into hour data of 5 bits and minute data of 6 bits. The hour data and the minute data produced from the encoding circuits 62 and 63 are applied to the AND circuits 23 and 25, respectively.

The operation of the timepiece thus constructed will be described. The time data, i.e. the hour data and the minute data, counted by the time counter 11 are transferred to the display device 2 where those are digitally displayed. The hour and minute data counted by the time counter 11 are always transferred as current time data to the coincidence circuit 28 of the alarm sounding section 5, by way of the AND circuit 26. In setting the alarm time, the pointer 3 is rotated by means of the knob 3*a* until the pointer 3 points to a desired time of day. When the battery is first set as a power source or the used battery is replaced by a new one, the pointer 3 is turned back once to the position of 0 hour and is turned to a position of a desired hour again. When the pointer 3 is turned back to the 0 hour position, the projection 33*c* of the pointer 3 comes in contact with the reference electrode C to produce a "1" signal to the lead wire 35*c*. The "1" signal is loaded through the OR circuit 36 to the DF/F circuit 37. The DF/F circuit 37 accepts the input signal in synchronism with the clock pulse $\phi$1 and produces the output signal in synchronism with the clock pulse $\phi$2. When the "1" signal is produced from the DF/F circuit 37, the output signal from the DF/F circuit 40 keeps "0" state until the next clock pulse $\phi$2 comes in, and at this time the output of the DF/F circuit 40 is kept at "1" state. When the "1" signal is produced from the DF/F circuit 37, the signal "1" is transferred through the AND circuit 39 to the up/down counter 43 to clear the contents of the counter 43. When the pointer 3 is set to the 0 hour position on the time scale, the projections 33*a* and 33*b* do not contact the fixed electrodes A and B, so that the signals on the lead wires 35*a* and 35*b* are in "0" state. Under this condition, when the pointer 3 is turned clockwise, the pointer 3 successively contacts the fixed electrode A1 at the first graduation of the time scale, the fixed electrodes A1 and B1 at the second graduation, and the fixed electrode B1 at the third graduation. At the fourth graduation, it does not contact the fixed electrodes A and B. This contact operation of the pointer 3 is repeated for each hour, subsequently. In this way, the pointer 3 is rotated from the 0 hour position to the first graduation and the projection 33*a* contacts the fixed electrode A1, a "1" signal is introduced into the lead wire 35*a*. The "1" signal is loaded into the DF/F circuit 45 in synchronism with the clock pulse $\phi$1 and is produced from the DF/F circuit 45 in synchronism with the clock pulse $\phi$2 and is applied to the AND circuit 52*a*. At this time, the output signals of the DF/F circuits 47 and 48 are both "0" and the output signals of the inverters 49 and 50 are "1". As a result, the AND circuit 51*a* produces a "1" signal which in turn is applied to the AND circuit 52*a*. When a "1" signal is applied from the DF/F circuit 45 to the AND circuit 52*a*, the output signal from the AND circuit 52*a* becomes "1" and the "1" signal is transferred through the OR circuit 56 to the up/down counter 43, so that the contents of the counter 43 is incremented by one (+1). Then, the output signal of the DF/F circuit 47 becomes "1" state in synchronism with the next clock pulses $\phi$1 and $\phi$2, so that the output signal of the inverter 49 becomes "0" and the output signals of the AND circuits 51*a* and 52*a* become "0". Following this, the pointer 3 is rotated to be "1" which in turn is applied to the AND circuit 52*c*. At this time, the output signals of the DF/F circuits 47 and 48 are both "1". Accordingly, the output of the AND circuit 51*c* becomes "1" which is applied to the AND circuit 52*c*. Under this condition, when a "1" signal is applied from the inverter 54 to the AND circuit 52*c*, the output signal from the AND circuit 52*c* becomes "1" and the "1" output signal is applied through the OR circuit 56 to the up/down counter 43 of which the contents is incremented by one (+1) to be "3". Succeedingly, the output signal of the DF/F circuit 47 becomes "0" in synchronism with the clock pulses $\phi$1 and $\phi$2, so that the output signals of the AND circuits 51*c* and 52*c* become "0" again. When the pointer 3 is further rotated to indicate the fourth graduation or the position of 1 hour, departing from the fixed electrode B1, the output signals of the lead wires 35*a* and 35*b* are both "0" and the output signal of the DF/F circuit 46 becomes "0" in synchronism with the clock pulses $\phi$1 and $\phi$2. As a result, the output signal of the inverter 55 becomes "1" and is then applied to the AND circuit 52*d*. At this time, the output signals of the DF/F circuit 48 and the inverter 49 are "1" and thus a "1" signal has been applied from the AND circuit 51*d* to the AND circuit 52*d*. Accordingly, when a "1" signal is applied from the inverter 55 to the AND circuit 52*d*, the output of the AND circuit 52*d* becomes "1" state, so that the up/down counter 43 is incremented by one "+1" to have "4". As described above, when the pointer 3 is turned clockwise, the AND circuits 52*a* to 53*d* produce "1" signals successively, so that the contents of the up/down counter 43 is counted up to have the value corresponding to the position pointed by the pointer 3.

When the pointer 3 is turned counterclockwise from the position of 0 hour, it departs from the reference electrode C at the first graduation or the 95th graduation while the projection 33*b* of the pointer 3 comes in contact with the fixed electrode B24. As a result, the signal delivered from the lead wire 35*c* becomes "0" while the signal from the lead wire 35*d* becomes "1". The "1" signal provided from the lead wire 35*b* is loaded into the DF/F circuit 40 in synchronism with the clock pulses $\phi$1 and $\phi$2 and then is applied to the AND circuit 41. The "0" signal outputted from the lead wire 35*c* is loaded through the OR circuit 36 to the DF/F circuit 40, to cause the output of the circuit 36 to be "0". At this time, a "1" signal is held by the DF/F circuit 40 and is applied to the AND circuit 41. Accordingly, the signal outputted from the DF/F circuit 46 is applied as a preset signal to the up/down counter 43, through the AND circuit 41, so that the contents of the up/down counter 43 are preset at "95". After this, a "0" signal is loaded into the DF/F circuit 40 in synchronism with the clock pulses $\phi$1 and $\phi$2 thereby to disable the AND gate 41. Then, the pointer 3 is turned to indicate the 94th scale, with the result that it contacts the fixed electrodes B24 and A24 to provide a "1" signal into the lead wires 35*a* and 35*b*. The "1" signal outputted from the lead wire 35*a* is loaded into the DF/F circuit 40 and is outputted toward the AND gate 53*d*, in synchronism with the clock pulses $\phi$1 and $\phi$2. At this time, the outputs of the DF/F 48 and the inverter 49 are both "1" and therefore a "1" signal is being applied from the AND gate 51*d* to the AND gate 53*d*. Accordingly, the output of the DF/F circuit 45 is produced from the AND circuit 53*d* and is transferred through the OR circuit 57 to the up/down counter 43. Upon receipt of the output signal, the contents of the counter 43 is decremented by one (−1) to become "94". Subsequently, the DF/F circuit 47 receives and produces a "1" signal in synchronism with the clock pulses $\phi$1 and $\phi$2, so that the output of the inverter 49 becomes "0" and the output signal state of the AND circuits 51*d* and 53*d* return to "0". Then, the pointer 3 is turned to indicate the 93th graduation, disconnecting from the fixed electrode B24. As a result, the output signal state of the lead wire 35*b* becomes "0" and the "0" signal is loaded into the DF/F circuit 46 in synchronism with the clock pulses $\phi$1 and $\phi$2. The "0" signal outputted from the DF/F circuit 46 is inverted into a "1" signal by the inverter 55 and the inverted signal is applied to the AND circuit 53*c*. At this time, the output signal states of the DF/F circuits 47 and 48 are both "1" and a "1" signal is being applied from the AND circuit 51*c* to the AND circuit 53*c*. Accordingly, the output signal from the inverter 55 is produced from the AND circuit 53*c* and is transferred through the OR circuit 57 to the up/down counter 43, so that the contents of the counter 43 is decremented by one (−1) to be "93". Following this, the "0" signal is loaded into the DF/F circuit 48 in synchronism with the clock pulses $\phi$1 and $\phi$2. Accordingly, the outputs of the AND gates 51*c* and 53*c* return to "0". The pointer 3 is further rotated to reach the 92nd graduation, i.e. the position of 23 hour to depart from the fixed electrode A24. At this time, the outputs of the lead wires 35*a* and 35*b* are both turned to be "0" and the "0" signal is loaded into the DF/F circuit 45 in synchronism with the clock pulses $\phi$1 and $\phi$2. As a result, the output state of the inverter 54 becomes "1" and the "1" output signal is inputted to the AND circuit 53*b*. At this time, the output states of the DF/F circuit 47 and the inverter 50 are both "1" and therefore the AND circuit 51*b* has applied a "1" signal to the AND circuit 53*b*. Accordingly, the "1" signal produced through the inverter 54 is applied to the up/down counter 43, through the AND circuit 53 and the OR circuit 57, so that the contents of the counter 43 is decremented by one (−1) to be "92". Then, in synchronism with the clock pulses $\phi$1 and $\phi$2 a "0" signal is loaded into the DF/F circuit 47 and the output states of the AND circuits 51*b* and 53*b* return to "0". The pointer 3 is further rotated up to the 91st graduation to be in contact with the fixed electrode B23. The contact of the pointer 3 with the fixed electrode B23 causes the lead wire 35*b* to produce a "1" signal. The "1" signal is loaded into the DF/F circuit 46 in synchronism with the clock pulses $\phi$1 and $\phi$2 and is applied to the AND circuit 53*a*. At this time, the output states of the AND circuit 51*a* and the inverter 42 are "1" and accordingly the output signal from the DF/F circuit 46 is outputted through the AND circuit 53*a* and is transferred through the OR circuit 57 to the up/down counter 43 whereby the contents of the counter 43 is decremented by one (−1) to be "91". Then, in synchronism with the clock pulses $\phi$1 and $\phi$2, a "1" signal is loaded into the DF/F circuit 48 and the output of the inverter 50 becomes "0" and the outputs of the AND circuits 51*a* and 53*a* return to "0". In this way, the pointer 3 is rotated counterclockwise, the AND circuits 53*d* to 53*a* successively produce "1" signals and the contents of the up/down counter 43 are counted down to be a value corresponding to the position of the pointer 3. In the above description, the rotation of the pointer 3 starts from the position of 0 hour; however, the above mentioned operation is correspondingly applicable for other cases where the pointer 3 is rotated from other positions on the time scale of the set time indicator 4. Also in such cases, when the pointer 3 is rotated clockwise, the up/down counter 43 is counted up, while when it is rotated counterclockwise, the counter 43 is counted down. Through those operations, the counter 43 has the contents corresponding to the position at which the pointer 3 points. The contents of the counter 43 is decoded by the decoder 58 into the time data of hour and minute and the decoded one are always applied to the coincidence circuit 28, through the AND circuit 25. The coincidence circuit 28 compares the alarm time applied from the detecting circuit 27 with the current time applied through the AND circuit 26 from the time count circuit 11. When those are coincident with each other, the coincidence circuit 28 produces a coincidence signal and a signal is fed to the speaker 32 to give the alarm.

For correcting the time of the time counter 11 by using the set time indicator 4, the pointer 3 is turned by means of the knob 3*a* to point at the correct time and then the time setting switch 6 is operated. When the time setting switch 6 is operated, a "1" signal is loaded into the DF/F circuit 16 in synchronism with the clock pulses $\phi$1 and $\phi$2 and is then applied to the AND circuit 18. At this time point, the output state of the DF/F circuit 17 is "0" and accordingly the output of the inverter 21 is "1". The output signal of the DF/F circuit 16 is outputted through the AND circuit 18 to clear the second counter 14 and the minute/hour counter 15. Then, when the "1" signal is loaded into the DF/F circuit 17 in synchronism with the clock pulses $\phi$1 and $\phi$2, the output of the inverter 21 becomes "0" to close the gate of the AND circuit 18. At this time, the output signal of the DF/F circuit 19 is "0", so that a "1" signal is applied from the inverter 22 to the AND circuit 20. The output signal from the DF/F circuit 17 is inputted to the AND circuit 23 through the AND circuit 20 thereby to enable the AND circuit 20. Accordingly, the hour data and the minute data, which are produced from the up/down counter 43 through the decoder 58, are transferred through the AND circuit 23 to the time count circuit 11 and then are set in the minute/hour counter 15. Following this, in synchronism with the clock pulses $\phi$1 and $\phi$2, a "1" signal is loaded into the DF/F circuit 19 and the inverter 22 produces a "0" signal to disable the AND circuits 20 and 23. At this time, the time count circuit 11 starts time counting operation with respect to the set time, with the result that the time counted is displayed by the display device 2.

For setting an alarm time, the pointer 3 is turned to point to the alarm time by means of the knob 3*a* in the set time indicator 4. When the pointer 3 is set to the alarm time, the contents of the up/down counter 43 is counted up or down to have the contents corresponding to the position pointed out by the pointer 3. The contents of the counter 43 is converted by means of the decoder 58 into the minute and hour data which are then applied to the coincidence circuit 28 within the alarm sounding section 5, through the AND circuit 25. The coincidence circuit 28 compares the alarm time applied through the AND circuit 25 from the detecting circuit 27 with the current time applied through the AND circuit 26 from the time count circuit 11. When these coincide with each other, the coincidence circuit 28 produces a coincidence signal which in turn drives the speaker 32 to give the alarm by a chime, for example.

In the above-mentioned embodiment, the display device 2 digitally displays time. However, the time may be displayed in an analog fashion with such a construction that 12 display elements are arranged to form a ring on the display section and 60 display elements are arranged to form a ring surrounding said ring.

The time scale of the above embodiment is graduated every 15 minutes but this may be graduated by other time units such as one minute and 30 minutes. In place of the single pointer 3, long and short pointers for indicating minute and hour may be used. The method to detect the position of the pointer 3 is not limited to that of the embodiment mentioned above.

The embodiment uses one pointer 3 for setting the usual time and the alarm time. Different pointers, however, may be used for setting those times respectively. In this case, a plurality of pointers may be provided for the alarm time setting and the alarm system operates as a multi-alarm. When a plurality of pointers are used, one of them is used for turning on a suitable electronic device such as a radio at the alarm time. The other one is used for turning off the radio at the alarm time indicated by the said other pointer.

Further, in the above-mentioned embodiment the pointer 3 is rotated to set a correcting time. As a modification, a vertical or horizontal rectilinear operation of the pointer is allowable for the same purpose.

What is claimed is:

1. An electronic timepiece comprising:

current time counting means for always electronically counting current time data including data representing at least minutes and hours;

optical display means coupled to said time counting means for always displaying the current time data counted by said time counting means;

indicating means including sliding means for selectively setting one of a plurality of set times represented by a selected stop position of said sliding means;

said current time counting means counting current time data independently of the setting of said indicating means, and said display means displaying said current time data for all settings of said indicating means;

clock generating means coupled to said sliding means for detecting sliding of said sliding means and for generating clock signals responsive to the detected sliding;

set time counting means coupled to said indicating means for obtaining set time data corresponding to the set time of said indicating means;

coincidence means coupled to said set time counting means and to said current time counting means for detecting a coincidence between said set time data and said current time data counted by said current time counting means;

sounding means coupled to said coincidence means and driven to generate a sound when said set time data is coincident with said current time data; and operating means coupled to said set time counting means and being selectively operable for presetting set time data corresponding to a set time of said indicating means into said current time counting means as initial current time data.

2. The electronic timepiece of claim 1, wherein said time counting means ceaselessly counts current time data for use in displaying said current time data by said optical display means.

3. The electronic timepiece according to claim 1 wherein said detecting means comprises storage means for storing the time data corresponding to the set time represented by said stopped position of said sliding means.

* * * * *